US009261298B2

(12) United States Patent
Wang et al.

(10) Patent No.: US 9,261,298 B2
(45) Date of Patent: Feb. 16, 2016

(54) EJECTOR CYCLE REFRIGERANT SEPARATOR

(75) Inventors: Jinliang Wang, Ellington, CT (US); Parmesh Verma, Manchester, CT (US); David P. Martin, East Hartford, CT (US); Frederick J. Cogswell, Glastonbury, CT (US)

(73) Assignee: Carrier Corporation, Farmington, CT (US)

( * ) Notice: Subject to any disclaimer, the term of this patent is extended or adjusted under 35 U.S.C. 154(b) by 382 days.

(21) Appl. No.: 13/810,050

(22) PCT Filed: Jul. 20, 2011

(86) PCT No.: PCT/US2011/044620

§ 371 (c)(1),
(2), (4) Date: Jan. 14, 2013

(87) PCT Pub. No.: WO2012/012491

PCT Pub. Date: Jan. 26, 2012

(65) Prior Publication Data

US 2013/0111934 A1 May 9, 2013

Related U.S. Application Data

(60) Provisional application No. 61/367,086, filed on Jul. 23, 2010.

(51) Int. Cl.

| | |
|---|---|
| ***F25B 1/06*** | (2006.01) |
| ***F25B 43/00*** | (2006.01) |
| ***F25B 41/00*** | (2006.01) |

(52) U.S. Cl.

CPC ..... *F25B 43/00* (2013.01); *F25B 41/00* (2013.01); *F25B 43/006* (2013.01); *F25B 2341/0011* (2013.01); *F25B 2400/03* (2013.01); *F25B 2400/13* (2013.01)

(58) Field of Classification Search

CPC ..... F25B 43/02; F25B 31/004; F25B 2341/0012; F25B 2400/23

USPC ..... 62/470, 500, 503, 511, 512

See application file for complete search history.

(56) References Cited

U.S. PATENT DOCUMENTS

| | | | |
|---|---|---|---|
| 1,836,318 | A | 12/1931 | Gay |
| 3,277,660 | A | 10/1966 | Kemper et al. |

(Continued)

FOREIGN PATENT DOCUMENTS

| | | | |
|---|---|---|---|
| CN | 1431440 | A | 7/2003 |
| CN | 1527007 | A | 9/2004 |

(Continued)

OTHER PUBLICATIONS

Office Action for Chinese Patent Application No. 201180036061.8, dated Jun. 4, 2014.

(Continued)

*Primary Examiner* — Melvin Jones

(74) *Attorney, Agent, or Firm* — Bachman & LaPointe, P.C.

(57) ABSTRACT

A system has a compressor (22, 412). A heat rejection heat exchanger (30) is coupled to the compressor to receive refrigerant compressed by the compressor. The system has a heat absorption heat exchanger (64). The system includes a separator (170) comprising a vessel having an interior. The separator has an inlet, a first outlet, and a second outlet. An inlet conduit may extend from the inlet and may have the conduit outlet positioned to discharge an inlet flow into the vessel interior to cause the inlet flow to hit a wall before passing to a liquid refrigerant accumulation in the vessel.

20 Claims, 4 Drawing Sheets

(56) References Cited

U.S. PATENT DOCUMENTS

| | | | | |
|---|---|---|---|---|
| 3,420,071 | A | 1/1969 | Bottum | |
| 3,592,017 | A | 7/1971 | Lipman et al. | |
| 3,754,409 | A | 8/1973 | Wreen, Jr. et al. | |
| 3,922,875 | A | 12/1975 | Morris, Jr. | |
| 3,990,264 | A | 11/1976 | Patnode et al. | |
| 4,018,583 | A | 4/1977 | Patnode et al. | |
| 4,329,854 | A | 5/1982 | Schmidt | |
| 4,434,626 | A | 3/1984 | Schmidt | |
| 5,024,061 | A | 6/1991 | Pfeil, Jr. et al. | |
| 6,397,621 | B1 | 6/2002 | Reynaud et al. | |
| 6,523,365 | B2 | 2/2003 | Zhang et al. | |
| 6,658,885 | B1 | 12/2003 | Zhou et al. | |
| 7,086,248 | B2 * | 8/2006 | Sakai et al. | 62/500 |
| 7,207,186 | B2 | 4/2007 | Hirota | |
| 7,340,908 | B2 | 3/2008 | Oshitani et al. | |
| 7,523,623 | B2 | 4/2009 | Taras et al. | |
| 8,079,229 | B2 * | 12/2011 | Lifson et al. | 62/238.6 |
| 2003/0024266 | A1 | 2/2003 | Zhang et al. | |
| 2003/0126883 | A1 | 7/2003 | Saito et al. | |
| 2004/0065112 | A1 | 4/2004 | Sakai et al. | |
| 2004/0237577 | A1 | 12/2004 | Nishida et al. | |
| 2005/0044865 | A1 * | 3/2005 | Manole | 62/149 |
| 2007/0028630 | A1 | 2/2007 | Yamada et al. | |
| 2008/0016887 | A1 | 1/2008 | Locke et al. | |
| 2008/0196446 | A1 | 8/2008 | Nakamura et al. | |
| 2008/0206084 | A1 | 8/2008 | Cho et al. | |
| 2009/0120120 | A1 | 5/2009 | Wiggs | |
| 2009/0193841 | A1 | 8/2009 | Sugitani | |
| 2009/0229306 | A1 | 9/2009 | Yamada et al. | |
| 2009/0293515 | A1 | 12/2009 | Lifson et al. | |
| 2010/0083679 | A1 | 4/2010 | Kolstad et al. | |
| 2010/0154467 | A1 | 6/2010 | Fujimoto et al. | |

FOREIGN PATENT DOCUMENTS

| | | | |
|---|---|---|---|
| CN | 101371085 | A | 2/2009 |
| EP | 1975526 | A1 | 10/2008 |
| JP | 11094401 | A | 4/1999 |
| JP | 2002039647 | A | 2/2002 |
| JP | 2002349978 | A | 12/2002 |
| JP | 200851344 | A | 3/2008 |
| KR | 2001-0065920 | A | 7/2001 |

OTHER PUBLICATIONS

International Search Report and Written Opinion for PCT/US2011/044620, dated Mar. 14, 2012.

Chinese Office Action for Chinese Patent Application No. 201180036061.8, dated Feb. 15, 2015.

* cited by examiner

EJECTOR CYCLE REFRIGERANT SEPARATOR

CROSS-REFERENCE TO RELATED APPLICATION

Benefit is claimed of U.S. Patent Application Ser. No. 61/367,086, filed Jul. 23, 2010, and entitled "Ejector Cycle Refrigerant Separator", the disclosure of which is incorporated by reference herein in its entirety as if set forth at length.

BACKGROUND

The present disclosure relates to refrigeration. More particularly, it relates to refrigerant separators.

Earlier proposals for ejector refrigeration systems are found in U.S. Pat. No. 1,836,318 and U.S. Pat. No. 3,277,660. FIG. 1 shows one basic example of an ejector refrigeration system 20. The system includes a compressor 22 having an inlet (suction port) 24 and an outlet (discharge port) 26. The compressor and other system components are positioned along a refrigerant circuit or flowpath 27 and connected via various conduits (lines). A discharge line 28 extends from the outlet 26 to the inlet 32 of a heat exchanger (a heat rejection heat exchanger in a normal mode of system operation (e.g., a condenser or gas cooler)) 30. A line 36 extends from the outlet 34 of the heat rejection heat exchanger 30 to a primary inlet (liquid or supercritical or two-phase inlet) 40 of an ejector 38. The ejector 38 also has a secondary inlet (saturated or superheated vapor or two-phase inlet) 42 and an outlet 44. A line 46 extends from the ejector outlet 44 to an inlet 50 of a separator 48. The separator has a liquid outlet 52 and a gas outlet 54. A suction line 56 extends from the gas outlet 54 to the compressor suction port 24. The lines 28, 36, 46, 56, and components therebetween define a primary loop 60 of the refrigerant circuit 27. A secondary loop 62 of the refrigerant circuit 27 includes a heat exchanger 64 (in a normal operational mode being a heat absorption heat exchanger (e.g., evaporator)). The evaporator 64 includes an inlet 66 and an outlet 68 along the secondary loop 62 and expansion device 70 is positioned in a line 72 which extends between the separator liquid outlet 52 and the evaporator inlet 66. An ejector secondary inlet line 74 extends from the evaporator outlet 68 to the ejector secondary inlet 42.

In the normal mode of operation, gaseous refrigerant is drawn by the compressor 22 through the suction line 56 and inlet 24 and compressed and discharged from the discharge port 26 into the discharge line 28. In the heat rejection heat exchanger, the refrigerant loses/rejects heat to a heat transfer fluid (e.g., fan-forced air or water or other fluid). Cooled refrigerant exits the heat rejection heat exchanger via the outlet 34 and enters the ejector primary inlet 40 via the line 36.

The exemplary ejector 38 (FIG. 2) is formed as the combination of a motive (primary) nozzle 100 nested within an outer member 102. The primary inlet 40 is the inlet to the motive nozzle 100. The outlet 44 is the outlet of the outer member 102. The primary refrigerant flow 103 enters the inlet 40 and then passes into a convergent section 104 of the motive nozzle 100. It then passes through a throat section 106 and an expansion (divergent) section 108 through an outlet 110 of the motive nozzle 100. The motive nozzle 100 accelerates the flow 103 and decreases the pressure of the flow. The secondary inlet 42 forms an inlet of the outer member 102. The pressure reduction caused to the primary flow by the motive nozzle helps draw the secondary flow 112 into the outer member. The outer member includes a (mixer having a convergent) section 114 and an elongate throat or mixing section 116. The outer member also has a divergent section or diffuser 118 downstream of the elongate throat or mixing section 116. The motive nozzle outlet 110 is positioned within the secondary nozzle convergent section 114. As the flow 103 exits the outlet 110, it begins to mix with the flow 112 with further mixing occurring through the mixing section 116 which provides a mixing zone. In operation, the primary flow 103 may typically be supercritical upon entering the ejector and subcritical upon exiting the motive nozzle. The secondary flow 112 is gaseous (or a mixture of gas with a smaller amount of liquid) upon entering the secondary inlet port 42. The resulting combined flow 120 is a liquid/vapor mixture and decelerates and recovers pressure in the diffuser 118 while remaining a mixture. Upon entering the separator, the flow 120 is separated back into the flows 103 and 112. The flow 103 passes as a gas through the compressor suction line as discussed above. The flow 112 passes as a liquid to the expansion valve 70. The flow 112 may be expanded by the valve 70 (e.g., to a low quality (two-phase with small amount of vapor)) and passed to the evaporator 64. Within the evaporator 64, the refrigerant absorbs heat from a heat transfer fluid (e.g., from a fan-forced air flow or water or other liquid) and is discharged from the outlet 68 to the line 74 as the aforementioned gas.

Use of an ejector serves to recover pressure/work. Work recovered from the expansion process is used to compress the gaseous refrigerant prior to entering the compressor. Accordingly, the pressure ratio of the compressor (and thus the power consumption) may be reduced for a given desired evaporator pressure. The quality of refrigerant entering the evaporator may also be reduced. Thus, the refrigeration effect per unit mass flow may be increased (relative to the non-ejector system). The distribution of fluid entering the evaporator is improved (thereby improving evaporator performance). Because the evaporator does not directly feed the compressor, the evaporator is not required to produce superheated refrigerant outflow. The use of an ejector cycle may thus allow reduction or elimination of the superheated zone of the evaporator. This may allow the evaporator to operate in a two-phase state which provides a higher heat transfer performance (e.g., facilitating reduction in the evaporator size for a given capability).

The exemplary ejector may be a fixed geometry ejector or may be a controllable ejector. FIG. 2 shows controllability provided by a needle valve 130 having a needle 132 and an actuator 134. The actuator 134 shifts a tip portion 136 of the needle into and out of the throat section 106 of the motive nozzle 100 to modulate flow through the motive nozzle and, in turn, the ejector overall. Exemplary actuators 134 are electric (e.g., solenoid or the like). The actuator 134 may be coupled to and controlled by a controller 140 which may receive user inputs from an input device 142 (e.g., switches, keyboard, or the like) and sensors (not shown). The controller 140 may be coupled to the actuator and other controllable system components (e.g., valves, the compressor motor, and the like) via control lines 144 (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

Various modifications of such ejector systems have been proposed. One example in US20070028630 involves placing a second evaporator along the line 46. US20040123624 discloses a system having two ejector/evaporator pairs. Another two-evaporator, single-ejector system is shown in US20080196446.

SUMMARY

One aspect of the disclosure involves a system having a compressor. A heat rejection heat exchanger is coupled to the compressor to receive refrigerant compressed by the compressor. The system has a heat absorption heat exchanger. The system includes a separator comprising a vessel having an interior. The separator has: an inlet; a first outlet; and a second outlet. An inlet conduit may extend from the inlet and may have the conduit outlet positioned to discharge an inlet flow into the vessel interior to cause the inlet flow to hit a wall before passing to a liquid refrigerant accumulation in the vessel.

In various implementations, an ejector may have: a primary inlet coupled to the heat rejection heat exchanger to receive refrigerant: a secondary inlet; and an outlet. The separator inlet may be coupled to an outlet of the ejector. An expansion device may be immediately upstream of the heat absorption heat exchanger. The refrigerant may comprise at least 50% carbon dioxide, by weight. The separator may also be used as a flash tank device for an economized cycle.

Other aspects of the disclosure involve methods for operating the system.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 3:
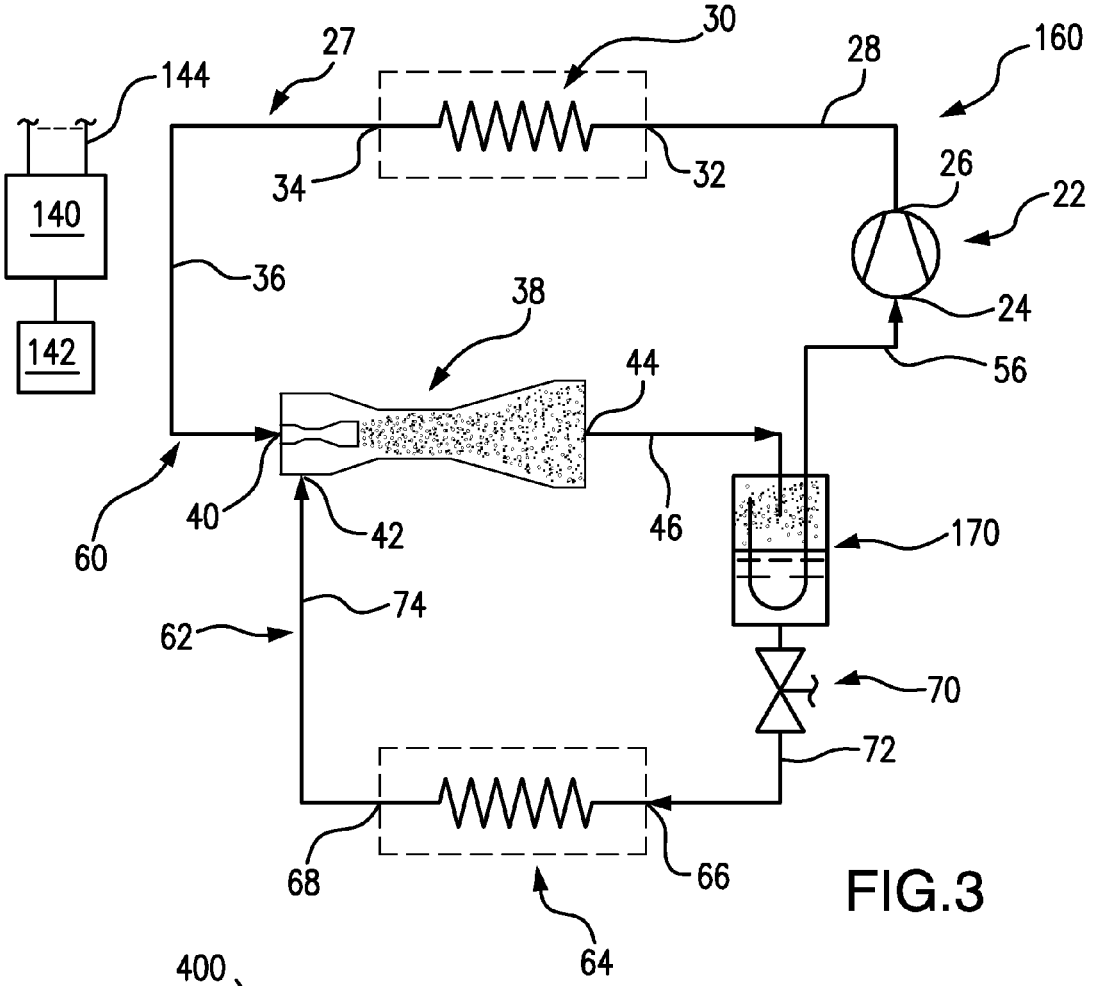
FIG. 3 is a schematic view of a first refrigeration system.

FIG. 3 shows an ejector cycle vapor compression (refrigeration) system 160. The system 160 may be made as a modification of the system 20 or of another system or as an original manufacture/configuration. In the exemplary embodiment, like components which may be preserved from the system 20 are shown with like reference numerals. Operation may be similar to that of the system 20 except as discussed below with the controller controlling operation responsive to inputs from various temperature sensors and pressure sensors.

Figure 1:
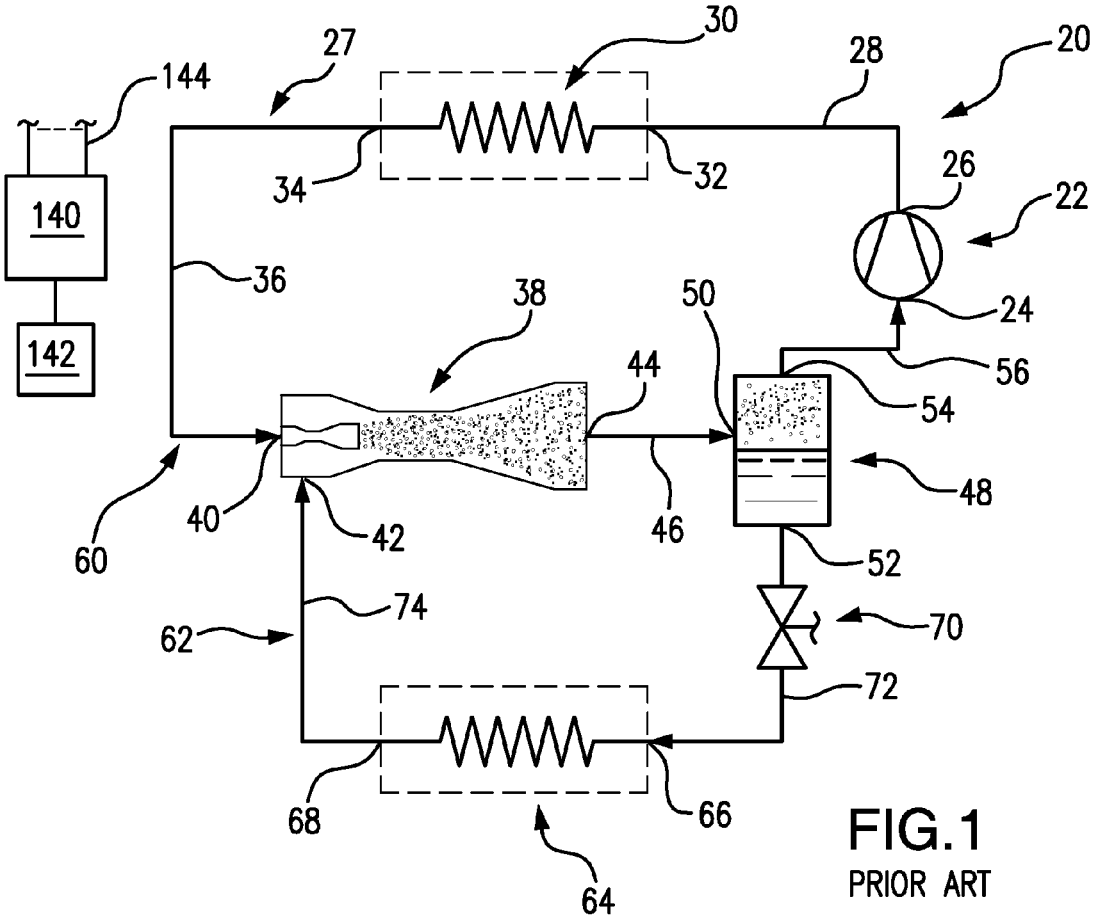
FIG.1 PRIOR ART
FIG. 1 is a schematic view of a prior art ejector refrigeration system.
Figure 2:
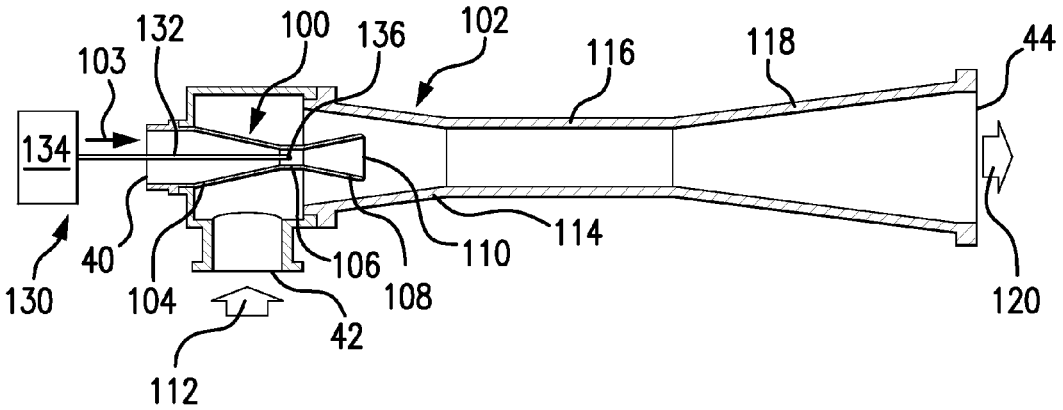
FIG. 2 PRIOR ART
FIG. 2 is an axial sectional view of an ejector.

The separator 48 of FIG. 1 is replaced with a separator that may more resemble an existing accumulator (e.g., is made or designed as a modification of an existing accumulator). The modification may add an additional outlet to the existing/baseline accumulator to form a separator liquid outlet. It may be desirable to avoid high velocity impact of the inlet flow with the accumulation in the separator. Such impact might cause foaming which could provide undesirable introduction of vapor refrigerant into the accumulation and therefrom through the liquid outlet. As is discussed further below, means are provided for deflecting the inlet flow to reduce the velocity with which the inlet flow encounters the accumulation.

Nevertheless, it may be desirable to provide a controlled amount of mixed phase outlet flow (e.g., a slight amount of vapor discharged through the liquid outlet and/or a slight amount of liquid discharged through the vapor or gas outlet). Means for providing such mixed phase flow may also be provided if desired. For example, by feeding a two-phase mixture into the compressor, the discharge temperature of the compressor can be reduced if desired (thus extending the compressor system operating range). Feeding a suction line heat exchanger (SLHX) and/or compressor with small amount liquid are also expected to improve both SLHX and compressor efficiency. Exemplary refrigerant is delivered as 85-99% quality (vapor mass flow percentage), more narrowly, 90-98% or 94-98%. Also by feeding a two-phase mixture to the expansion valve upstream of the evaporator one can precisely control the system capacity, which can prevent unnecessary system shutdowns (comfort and improved reliability) and improve temperature control. This may help improve refrigerant distribution in the evaporator manifold and further improve evaporator performance Exemplary refrigerant is delivered as 1-10% quality (vapor mass flow percentage), more narrowly 2-6%.

The exemplary separator 170 (FIG. 4) may be based upon a conventional accumulator. The modified accumulator has a tank or vessel 172, an inlet 174, a first outlet 176 for discharging the vapor (or high quality) refrigerant 177, and a second outlet 178 for discharging the liquid (or low quality) refrigerant 179. The baseline accumulator has an inlet conduit 180 which extends to a downstream end 182 which would otherwise form the outlet of the inlet conduit. The exemplary end 182 is within a headspace 194 which would be above the accumulation 200. The baseline accumulator is modified by inserting an upper end 184 of a tube insert 185 into the inlet conduit (and securing via welding, clamping, or the like). The conduit 182 thus becomes a first member/portion of the resulting inlet conduit (assembly) while the insert 185 becomes the second member/portion.

A lower end 186 of the tube insert 185 is closed and sits on the bottom 187 of the vessel (e.g., for support so as to minimize stress on the joint with the inlet conduit 182). Along an intermediate portion (still above a surface of the accumulation 200) the tube insert 185 bears apertures (holes) 188. The apertures 188 deflect the inlet flow 120 to reduce the velocity with which the inlet flow encounters the accumulation. For example, the apertures 188 may cause the inlet flow to deflect off the inner surface of the sidewall 189 of the vessel (e.g., flow down the sidewall to the accumulation). This deflection reduces foaming in the accumulation 200 and helps provide controlled balances of vapor and liquid in the flows 177 and 179.

In one exemplary implementation, the inlet tube has an inner diameter (ID) of 15.9 mm which corresponds to a particular standard tube size. Other sizes may be used depending upon system requirements.

In the example, the holes 188 are grouped in two rows of five holes with each hole of one group diametrically opposite an associated hole of the other group. The exemplary holes are 0.25 inch (6.35 mm) in diameter. Other patterns of holes may be provided. For example, the patterns may be provided to create specific flow patterns, to accommodate other internal components, or the like. Similarly, hole orientation may be varied off radial or off horizontal. For example, angling of the holes upward at angles of up to 45° off horizontal/radial may allow the flows along the sidewall to use more of the sidewall. More broadly, an exemplary tube size for the inlet conduit or an insert therein is one eighth of an inch to two inches (3.2 mm-50.8 mm). Similarly, an exemplary range of hole sizes (especially for drilled holes) is 0.8 mm-20 mm in diameter depending upon the desired flow rate, conduit size, etc. Non-circular holes may have similar exemplary cross-sectional areas. An exemplary ratio of total hole area to local tube internal cross-sectional area is 0.5-20, more narrowly 1-5 or 1-2.

The exemplary first outlet 176 is at the downstream end of a U-tube (or J-tube) 190. The U-tube extends to a second end (gas inlet end) 192 open to the headspace 194 of the tank for drawing a flow 196 of gas from the headspace. A lower portion (trough or base) 198 of the U-tube is immersed in the liquid refrigerant accumulation 200 in a lower portion of the tank, below the headspace. To entrain the desired amount of liquid 202 into the gas flow to form the high quality flow 177, one or more holes 204 may be formed along the U-tube, including in the lower portion 198. The hole sizing and locations are configured to provide the desired quality of two phase mixture entering the SLHX and/or compressor. An exemplary hole size for a drilled hole is 0.01 inch-0.5 inch (0.25 mm-12.7 mm), more narrowly 0.2-0.3 inch (5.1-7.6 mm). Multiple holes may be used and may be placed to achieve desired results.

To provide the small amount of gas in the low quality flow 179, one or more vapor line tubes 220 may extend from a portion 222 having one or more gas inlets (holes) 224 in the headspace. An exemplary portion 222 is a closed end upper portion. A second portion 226 (a lower portion) has one or more holes 228 within the liquid accumulation 200. The sizes of the holes 228 and 224 are selected so that a flow 230 of gaseous refrigerant is drawn through the holes 224 and becomes entrained in a flow of liquid refrigerant 232 drawn through the holes 228 to provide the desired composition of the low quality flow 179. Exemplary size for the holes 224 is up to two inches (50 mm) in diameter for drilled holes or equivalent area for others, more narrowly, 0.1-0.5 inches (2.5-13 mm) or 0.1-0.3 inches (2.5-7.6 mm). Exemplary size for the holes 228 is 0.1-2 inches in diameter for drilled holes or equivalent area for others, more narrowly f 0.2-1.0 inches (5-25 mm) or 0.25-0.75 inches (6.35-19.1 mm). The ratio of hole sizes (224 vapor to 228 liquid) is 0 to 0.9; more narrowly 0.1 to 0.5; more narrowly 0.1 to 0.3.

Figure 4:
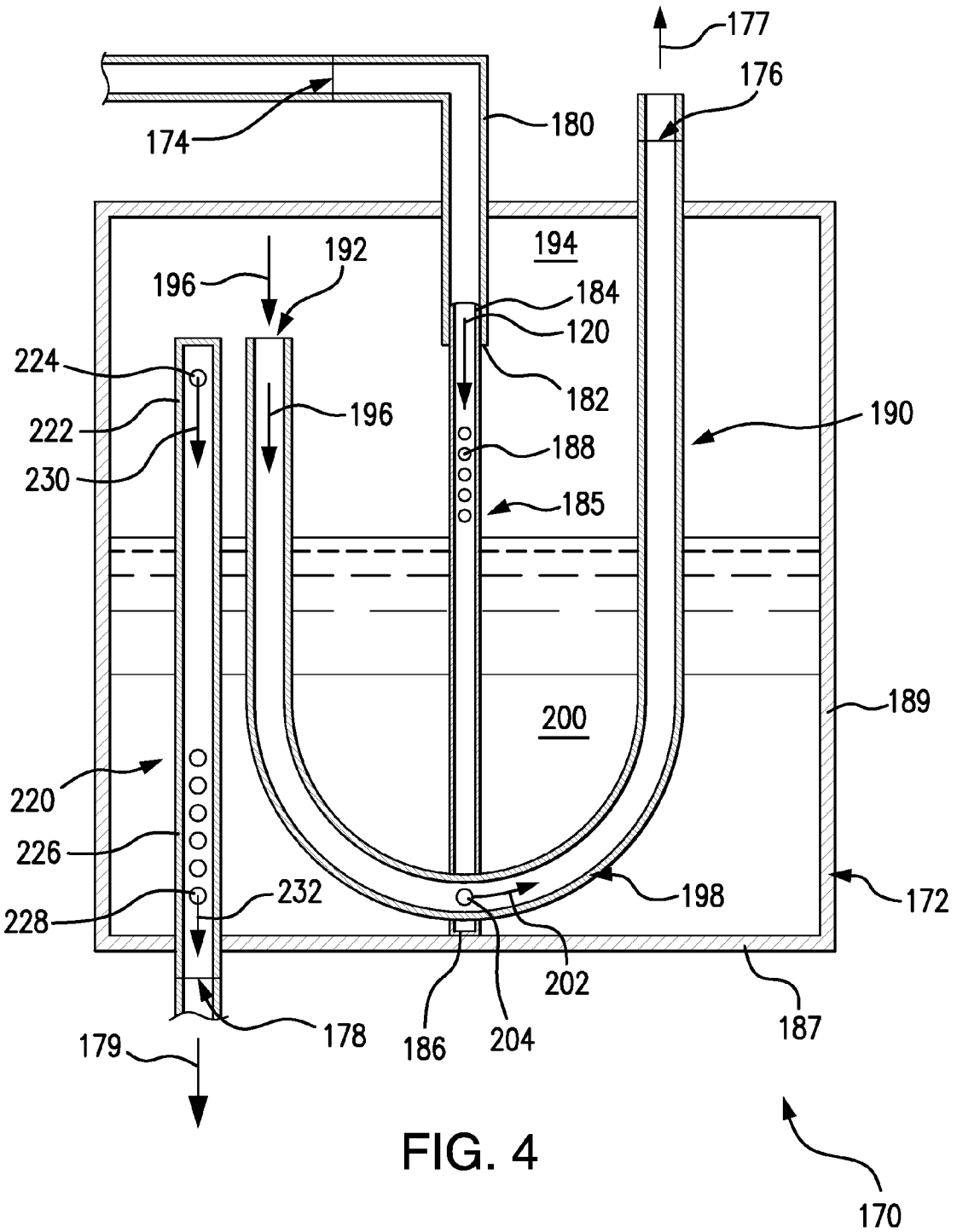
FIG. 4 is an enlarged view of a separator of the system of FIG. 3.
Figure 5:
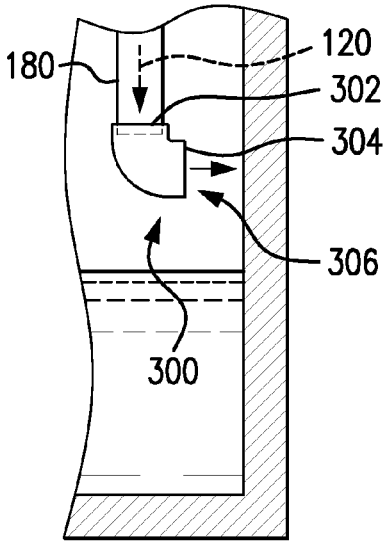
FIG. 5 is a partial, partially schematic, cutaway view of an alternate separator.

FIGS. 5-10 show alternate separators which may otherwise be similar to the separator of FIG. 4. In FIG. 5, the flow 120 is directed directly to the vessel sidewall (e.g., via an elbow 300) having a first end 302 attached to the inlet conduit 180 and a second end 304 (forming an outlet 306 of the resulting inlet conduit) in close facing proximity to the sidewall to discharge the flow directly against the sidewall. The elbow 300 may be of an appropriate existing fitting type compatible with the inlet conduit.

Figure 6:
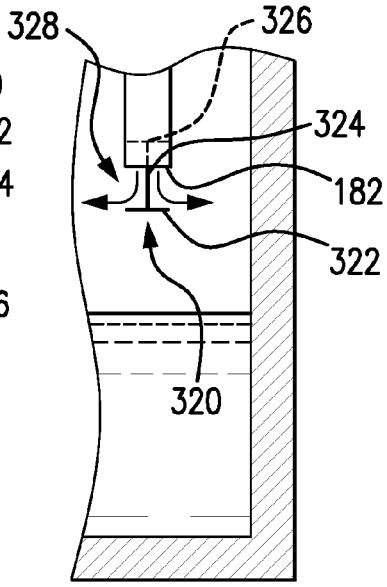
FIG. 6 is a partial, partially schematic, cutaway view of a second alternate separator.

FIG. 6 shows a diverter 320 having a plate 322 (e.g., a round flat metallic plate) held spaced apart from the inlet conduit end 182 (e.g., via a metal or other shaft 324) mounted to a spider or other spacer 326 which is mounted to the inlet conduit (e.g., via welding, brazing, or the like). The annular gap 328 between the rim/outlet 182 of the conduit first portion and the plate 322 thus becomes the outlet of the resulting conduit assembly. The exemplary inlet flow is deflected laterally by the plate to impact the sidewall.

Figure 7:
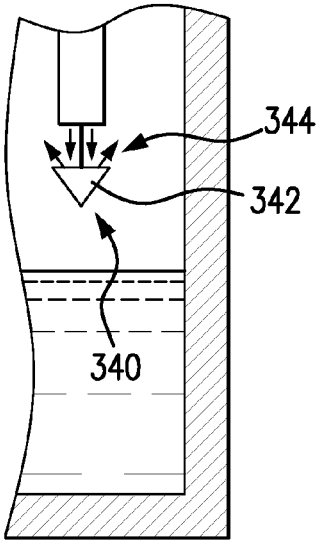
FIG. 7 is a partial, partially schematic, cutaway view of a third alternate separator.

FIG. 7 shows an alternate diverter 340 which may be otherwise similar to the alternate diverter 320. However, the plate is replaced by a conical or otherwise upwardly concave structure 342. Similar to the diverter 320, the annular space/gap 344 becomes the effective outlet of the conduit assembly. This configuration deflects the inlet flow back upward to impact higher along the sidewall and at a lower angle of incidence to yet further reduce possibilities of entraining vapor during the impact.

Figure 8:
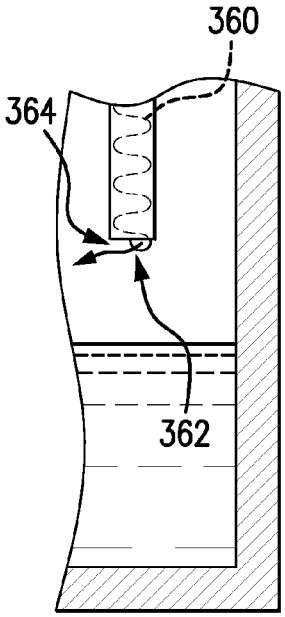
FIG. 8 is a partial, partially schematic, cutaway view of a fourth alternate separator.

FIG. 8 shows a helical baffle 360 inserted within the inlet conduit 182 and mounted thereto (e.g., via welding, brazing, or the like). The baffle may slow the flow and encourage separation of the vapor and liquid as the inlet flow flows along the baffle. The baffle may also cause a lateral discharge of the inlet flow to impact the sidewall as in other embodiments. For example, the positioning of a lower end portion 362 of the baffle 360 may provide an effective opening 364 below the conduit end 182 of the conduit first portion.

Figure 9:
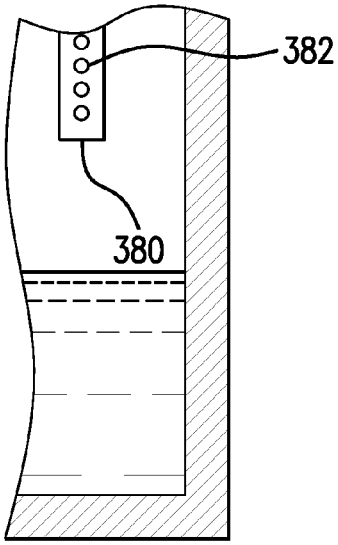
FIG. 9 is a partial, partially schematic, cutaway view of a fifth alternate separator.

FIG. 9 shows the downstream end 380 of the inlet conduit closed off relative to the baseline end 182. Holes 382 may be positioned along the inlet conduit and may function in a similar fashion to the holes 188. Alternatively, the holes may be formed along an insert with the end being above the vessel bottom and not supported thereby.

Figure 10:
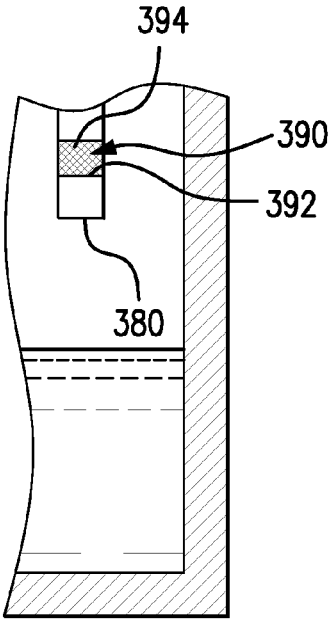
FIG. 10 is a partial, partially schematic, cutaway view of a sixth alternate separator.

FIG. 10 replaces the holes 382 with the apertures 394 of a foraminate member 390 (e.g., a mesh or perforated sheet) secured across a large lateral aperture/opening 392. An exemplary foraminate member has an open area percentage of 10-95%, more narrowly, 20-80% or 50-70%. An exemplary pore size (e.g., a diameter of a circular pore or a length/width of a square mesh pore) is 0.01 inch-0.5 inch (0.25 mm-12.7 mm), more narrowly, 1.27-3.81 mm. The air ratio of total opening size to tube cross-sectional area may be so much of that discussed for the embodiment of FIG. 4.

Figure 11:
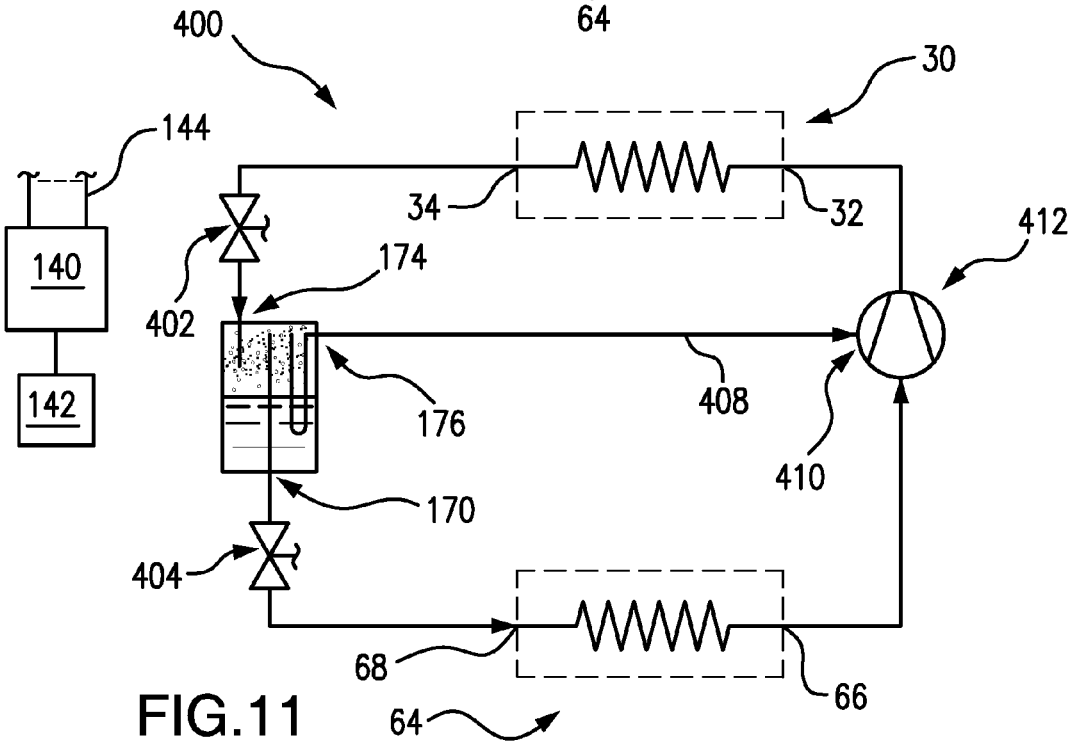
FIG. 11 is a schematic view of a second refrigeration system.

The separators may also be used as flash tank economizers. FIG. 11 shows an alternate refrigeration system 400 wherein the separator 170 is positioned between first and second expansion devices 402 and 404. The first expansion device receives refrigerant from the gas cooler and expands the refrigerant. The inlet 174 receives the expanded refrigerant. The first outlet 176 is coupled via an economizer line 408 to the economizer port (intermediate port) 410 of the compressor 412 to deliver the high quality refrigerant. The second outlet 178 is coupled to the second expansion device to deliver the low quality refrigerant. The second expansion device expands the refrigerant for delivery to the evaporator and, thereafter, return to the compressor suction port.

The systems may be fabricated from conventional components using conventional techniques appropriate for the particular intended uses.

Although embodiments are described above in detail, such description is not intended for limiting the scope of the present disclosure. It will be understood that various modifications may be made without departing from the spirit and scope of the disclosure. For example, when implemented in the remanufacturing of an existing system or the reengineering of an existing system configuration, details of the existing configuration may influence or dictate details of any particular implementation. Accordingly, other embodiments are within the scope of the following claims.

What is claimed is:

1. A system comprising:
a compressor;
a heat rejection heat exchanger coupled to the compressor to receive refrigerant compressed by the compressor;
a heat absorption heat exchanger; and
a separator comprising:
a vessel having an interior;
an inlet;
a first outlet;
a second outlet; and
an inlet conduit extending from the inlet and having a closed lower end and lateral apertures forming a conduit outlet positioned to discharge an inlet flow into the vessel interior to cause the inlet flow to hit a wall before passing to a liquid refrigerant accumulation in the vessel.

2. The system of claim 1 further comprising:
an ejector having:
a primary inlet coupled to the heat rejection heat exchanger to receive refrigerant;
a secondary inlet; and
an outlet,
wherein:
the inlet of the separator is coupled to the outlet of the ejector; and
the second outlet of the separator coupled to the heat absorption heat exchanger to deliver refrigerant to the heat absorption heat exchanger.

3. The system of claim 2 wherein:
the system has no other ejector; and
the system has no other compressor.

4. A method for operating the system of claim 2 comprising running the compressor in a first mode wherein:
the refrigerant is compressed in the first compressor;
refrigerant received from the first compressor by the heat rejection heat exchanger rejects heat in the heat rejection heat exchanger to produce initially cooled refrigerant;
the initially cooled refrigerant passes through the ejector;
an outlet flow of refrigerant from the ejector passes to the separator, forming the liquid refrigerant accumulation with a headspace thereabove; and
the outlet flow becomes the inlet flow into the vessel interior and is deflected from the wall.

5. The system of claim 1 wherein:
the separator is positioned as an economizer.

6. The system of claim 1 wherein:
refrigerant comprises at least 50% carbon dioxide, by weight.

7. The system of claim 1 wherein the wall is an exterior sidewall and the conduit outlet is positioned so that flow is deflected off an inner surface of the wall.

8. The system of claim 1 wherein:
the closed lower end is spaced above a bottom of the vessel.

9. The system of claim 1 wherein:
the lateral apertures are in a mesh or screen across a lateral opening.

10. The system of claim 1 wherein:
the closed lower end is supported by a bottom of the vessel.

11. The system of claim 10 wherein:
the lateral apertures are above the liquid refrigerant accumulation in the vessel interior.

12. The system of claim 11 wherein:
the lateral apertures are in a mesh or screen across a lateral opening.

13. The system of claim 1 wherein a tube has a portion immersed in the liquid refrigerant accumulation and has at least one hole along the portion, at least one hole positioned to entrain liquid from the accumulation in a flow of gas through the tube from a headspace to the first outlet.

14. The system of claim 13 wherein:
the tube is a U-tube having a gas inlet end open to the headspace and extending to the first outlet.

15. The system of claim 1 further comprising:
an expansion device directly upstream of the heat absorption heat exchanger inlet.

16. A system comprising:
a compressor;
a heat rejection heat exchanger coupled to the compressor to receive refrigerant compressed by the compressor;
a heat absorption heat exchanger; and
a separation device having:
an inlet;
a first outlet;
a second outlet coupled to the heat absorption heat exchanger to deliver refrigerant to the heat absorption heat exchanger; and
means for limiting foaming of an accumulation of refrigerant.

17. The system of claim 16 wherein:
the means is means for directing an inlet flow of refrigerant to impact a wall of a vessel of the separation device before encountering the accumulation.

18. A system comprising:
a compressor;
a heat rejection heat exchanger coupled to the compressor to receive refrigerant compressed by the compressor;
a heat absorption heat exchanger; and
a separator comprising:
a vessel having an interior;
an inlet;
a first outlet;
a second outlet; and
an inlet conduit extending from the inlet and having a conduit outlet positioned to discharge an inlet flow into the vessel interior to cause the inlet flow to hit a wall before passing to a liquid refrigerant accumulation in the vessel, the inlet conduit comprising an open end and a deflector between the open end and the accumulation.

19. The system of claim 18 wherein the deflector comprises:
an open end and a spiral deflector at least partially within the conduit.

20. The system of claim 18 wherein the deflector comprises:
a concavity facing the open end.

* * * * *